US008757643B2

(12) United States Patent
Arthur et al.

(10) Patent No.: US 8,757,643 B2
(45) Date of Patent: Jun. 24, 2014

(54) RETRACTABLE WHEEL ASSEMBLY

(71) Applicants: Joseph I. Arthur, Palm Bay, FL (US); Aron Bacs, Jr., Orlando, FL (US)

(72) Inventors: Joseph I. Arthur, Palm Bay, FL (US); Aron Bacs, Jr., Orlando, FL (US)

(73) Assignee: Retrac Enterprises Inc, Palm Bay ( * ) Notice: Subject to any disclaimer, the term of this patent is extended or adjusted under 35 U.S.C. 154(b) by 0 days.

(21) Appl. No.: 14/068,873

(22) Filed: Oct. 31, 2013

(65) Prior Publication Data

US 2014/0060990 A1 Mar. 6, 2014

Related U.S. Application Data

(62) Division of application No. 13/477,655, filed on May 22, 2012.

(51) Int. Cl.
*B62B 3/02* (2006.01)

(52) U.S. Cl.
USPC ..... 280/37; 190/18 A; 16/34

(58) Field of Classification Search
USPC ..... 280/37, 643, 645, 42, 651, 652, 43, 280/43.1, 47.131, 47.15, 47.16, 47.17, 280/47.18, 47.19, 47.2, 47.22, 47.23, 47.24, 280/47.26, 47.34, 47.35, 47.315, 47.331, 280/7.17; 114/344; 16/32, 34; 190/18 A, 190/107, 108, 109, 110, 115
See application file for complete search history.

(56) References Cited

U.S. PATENT DOCUMENTS

| | | | | |
|---|---|---|---|---|
| 44,936 | A * | 11/1864 | Clapp | 280/46 |
| 497,557 | A * | 5/1893 | Seyller | 16/34 |
| 2,463,713 | A | 3/1949 | Partiot | |
| 2,472,491 | A * | 6/1949 | Quinton | 280/37 |
| 2,510,754 | A * | 6/1950 | Norlin | 280/38 |
| 2,539,993 | A * | 1/1951 | Davis | 280/645 |
| 2,581,417 | A * | 1/1952 | Jones | 280/645 |
| 2,788,219 | A * | 4/1957 | McClellan | 280/43.15 |
| 2,930,152 | A * | 3/1960 | Pipkin | 37/434 |
| 3,141,680 | A * | 7/1964 | McCord et al. | 280/38 |
| 3,197,226 | A | 7/1965 | Erlinder | |
| 3,376,047 | A | 4/1968 | Schuster | |
| 3,413,011 | A * | 11/1968 | Weitzner | 280/37 |
| 3,462,171 | A * | 8/1969 | Mitty et al. | 280/47.26 |
| 3,917,038 | A * | 11/1975 | Foge et al. | 190/18 A |
| 4,087,102 | A * | 5/1978 | Sprague | 280/37 |

(Continued)

FOREIGN PATENT DOCUMENTS

| | | |
|---|---|---|
| GB | 2124589 | 2/1984 |

*Primary Examiner* — Katy M Ebner
*Assistant Examiner* — Brodie Follman
(74) *Attorney, Agent, or Firm* — JP Webb; Jason P. Webb; Danny Y. H. Cheng

(57) ABSTRACT

A retractable wheel assembly includes a bracing member and a wheeled arm pivotally coupled to the bracing member. The wheeled arm is sized and positioned such that the wheeled arm rotates through an aperture of the bracing member. The wheeled arm includes an arm member, a wheel, and an aperture cover shaped and positioned such that when the wheeled arm is in a retracted mode, the aperture cover covers a majority of the aperture, but not substantially all, thereby forming a wheel gap. The wheel assembly includes a deployment arm and a trap member operationally coupled to the deployment arm, including a trap flange sized and positioned to cover the wheel gap when in a closed mode and to substantially uncover the wheel gap in an open mode. The retractable wheel assembly includes a handle operationally coupled to the trap member.

17 Claims, 12 Drawing Sheets

(56) References Cited

U.S. PATENT DOCUMENTS

| | | | | | |
|---|---|---|---|---|---|
| 4,097,955 | A * | 7/1978 | Foge et al. | 16/29 |
| 4,254,850 | A * | 3/1981 | Knowles | 190/18 A |
| 4,273,222 | A * | 6/1981 | Cassimally et al. | 190/18 A |
| 4,397,062 | A * | 8/1983 | Huang | 16/33 |
| 4,575,109 | A * | 3/1986 | Cowdery | 280/37 |
| 4,588,055 | A * | 5/1986 | Chen | 190/18 A |
| 4,588,203 | A * | 5/1986 | Anderson | 280/47.331 |
| 4,773,123 | A * | 9/1988 | Yu | 16/34 |
| 4,979,598 | A * | 12/1990 | Verheij et al. | 190/18 A |
| 5,149,113 | A * | 9/1992 | Alldredge | 280/30 |
| 5,303,805 | A | 4/1994 | Hauser | |
| 5,431,262 | A | 7/1995 | Rekuc et al. | |
| 5,524,737 | A | 6/1996 | Wang | |
| 5,526,908 | A * | 6/1996 | Wang | 190/115 |
| 5,533,231 | A * | 7/1996 | Bai | 16/34 |
| 5,564,538 | A | 10/1996 | Sadow | |
| 5,813,503 | A * | 9/1998 | Chang | 190/18 A |
| 6,176,357 | B1 | 1/2001 | Kuo | |
| 6,179,176 | B1 * | 1/2001 | Saggese et al. | 224/153 |
| 6,196,561 | B1 | 3/2001 | Trassinelli | |
| 6,220,412 | B1 | 4/2001 | Lin | |
| 6,289,554 | B1 * | 9/2001 | Wang | 16/34 |
| 6,360,400 | B1 * | 3/2002 | Chang | 16/113.1 |
| 6,367,602 | B1 * | 4/2002 | Chang | 190/18 A |
| 6,454,065 | B1 * | 9/2002 | Chen | 190/18 A |
| 6,507,975 | B2 * | 1/2003 | Maupin et al. | 16/34 |
| 6,550,967 | B2 | 4/2003 | Hedaya | |
| 6,604,615 | B2 * | 8/2003 | Wu | 190/18 A |
| 6,612,411 | B2 * | 9/2003 | Nykoluk et al. | 190/18 A |
| 6,769,701 | B1 * | 8/2004 | Clausen | 280/37 |
| 6,802,515 | B2 * | 10/2004 | Sorenson et al. | 280/47.26 |
| 7,066,311 | B2 | 6/2006 | O'Shea | |
| 7,165,661 | B2 | 1/2007 | Miyoshi | |
| 7,237,660 | B2 * | 7/2007 | Wu | 190/18 A |
| 7,500,680 | B2 * | 3/2009 | Dayton et al. | 280/37 |
| 7,644,743 | B2 * | 1/2010 | Fenton et al. | 150/115 |
| 7,861,834 | B2 * | 1/2011 | Gorga et al. | 190/18 A |
| 7,997,591 | B2 * | 8/2011 | Arthur | 280/37 |
| 8,091,903 | B2 * | 1/2012 | Barrott | 280/43.17 |
| 2003/0085088 | A1 * | 5/2003 | Wu | 190/18 A |
| 2004/0000457 | A1 * | 1/2004 | Sanford-Schwentke | 190/18 A |
| 2004/0163910 | A1 * | 8/2004 | Lee | 190/18 A |
| 2005/0178630 | A1 * | 8/2005 | Wu | 190/18 A |
| 2005/0236242 | A1 * | 10/2005 | Fenton et al. | 190/115 |
| 2008/0236972 | A1 * | 10/2008 | Lee et al. | 190/18 A |
| 2009/0160147 | A1 * | 6/2009 | Arthur | 280/35 |
| 2010/0025174 | A1 * | 2/2010 | Dayton | 190/18 A |
| 2012/0261223 | A1 * | 10/2012 | Pattni | 190/18 A |
| 2013/0313795 | A1 * | 11/2013 | Arthur et al. | 280/43.17 |

* cited by examiner

RETRACTABLE WHEEL ASSEMBLY

CROSS-REFERENCE TO RELATED APPLICATIONS

This application is a Divisional Application of, under 35 U.S.C. §121, and claims priority to, under 35 U.S.C. §121, U.S. Non-Provisional application Ser. No. 13/477,655, entitled Retractable Wheel Assembly, by Joseph I. Arthur, filed on May 22, 2012.

BACKGROUND OF THE INVENTION

1. Field of the Invention

The present invention relates to wheel assemblies, specifically to a retractable wheel assembly.

2. Description of the Related Art

Luggage, including suitcases and the like, is often heavy, bulky, and generally unwieldy. Travelers, in particular, often have multiple articles of luggage, which are not easily simultaneously transported by a single person. Although suitcases are frequently provided with wheels, the user must wither hunch over, or otherwise lower his or her arms, in order to grasp the handle of the suitcase while the wheels contact the floor, or stand erect and carry the suitcase, and often project the suitcase. Further, wheel assemblies project from suitcases and may be damaged during handling by the airlines. Also, such may present difficulties when the user wishes to have the suitcase stably positioned on the floor.

A separate luggage carrier with wheels and an extendible handles may be utilized to overcome these problems. However, such carriers have open frames that leave the wheel assemblies of the luggage carriers exposed to damage during handling by the airlines.

Retractable wheels and/or handles are known in the art and are generally provided to help reduce exposure of the wheels to the exterior. Different retraction mechanisms are used to provide different operational characteristics to varying degrees of success.

Some improvements have been made in the field. Examples of references related to the present invention are described below in their own words, and the supporting teachings of each reference are incorporated by reference herein:

U.S. Pat. No. 5,431,262, issued to Rekuc et al., discloses an article of luggage has a handle received in a frame disposed along the interior rear wall of a flexible case to allow the article to be pulled along the ground or floor on wheels mounted in a wheel assembly affixed to the bottom of an article. The bottom plate has a pull-out ledge on which other luggage can be mounted and held in place by an elastic strap which is affixed to the case and can encircle the additional article or be buckled out of the way along the outer rear wall of the case.

U.S. Pat. No. 7,165,661, issued to Miyoshi, discloses a bag mounted with casters has a bag body attached to a base frame mounted with the casters at four corners of a bottom surface thereof. The base frame includes a loading table, and vertically extensible rods with a grip mounted at upper ends thereof. The extensible rods are fixed on one side of the loading table so as to stand on their own. Further, when the grip is raised, the extensible rods are curved or tilted so that the grip moves toward the middle of the loading table. The extensible rods are secured at a position in a retracted state by stoppers so that the grip is positioned at an upper portion of the bag body or above the bag body, and are secured at a position by the stoppers in an extended state so that a height of the grip from the bottoms of the casters is in a range of 60 to 100 cm.

U.S. Pat. No. 5,513,873, issued to Chen, discloses a handle of a push cart includes two rods slidably engaged in two tubes and each having a number of teeth. Two sleeves are secured on top of the tubes and each has a pair of lugs. Two pins are secured between the lugs. A resilient arm has two ends slidably engaged with the pins, the ends each includes a tooth for engaging with the teeth of the rods so as to secure the rods to the tubes. The teeth of the resilient arm are disengaged from the teeth of the rods when the resilient arm is depressed. A fence is secured to the sleeves for preventing the resilient arm from being depressed inadvertently.

U.S. Pat. No. 5,524,737, issued to Wang, discloses a retractable handle and wheel assembly includes a flat handle mounting frame and a circularly arched wheel mounting frame joined together and mounted on the back and bottom panel of a collapsible travel bag. Two wheel holders are respectively fastened to the wheel mounting frame each wheel holder having a wheel coupling portion fitted over a respective recessed hole on the wheel mounting frame to hold a respective wheel by a bearing and a channel bar bearing block fixedly fastened to the handle mounting frame to hold a respective channel bar, with a retractable handle sliding in an out of the channel bars, the retractable handle having two rubber blocks at two adjacent ends for positioning the handle at either end of each channel bar to hold the handle in the collapsed or extended out position.

U.S. Pat. No. 3,376,047, issued to Schuster, discloses a collapsible vehicle for the transportation of tools, suitcases, shopping bags, sport equipment, etc., which includes a frame of isosceles trapezoidal configuration defined by hingedly interconnected member cooperating with a support and a releasable latch, the front and rear members having a total length equal to the combined length of the size of the trapezoid, which is swingable so that the members can lie substantially parallel to one another.

The inventions heretofore known suffer from a number of disadvantages which include limited in use, being limited in adaptability, being limited in application, being unable to fully close and secure the wheel therein, being bulky, being difficult to adapt to existing luggage, being expensive, being less durable, being subject to damage during use or storage, causing damage to surrounding materials during use or storage, failing to protect a user's investment in their luggage, failing to increase a perceived value of the luggage, causing frustration to users when trying to store luggage in overhead bins, failing to permit refitting of existing containers, causing damage during unintentional deployment, permitting unintentional deployment, failing to prevent intrusion by foreign objects into a retraction mechanism, being heavy, taking up too much interior luggage space, taking up too much exterior luggage space, and not permitting independent wheel deployment and the like and combinations thereof.

What is needed is a retractable wheel assembly that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available retractable wheel assemblies. Accordingly, the present invention has been developed to provide a retractable wheel assembly that is easy to install and secure within luggage without being too bulky.

According to one embodiment of the invention, there is a retractable wheel assembly that may include a bracing member. The bracing member may include a side panel. The bracing member may include a front panel that may be coupled to the side panel and may include an aperture disposed therethrough.

The retractable wheel assembly may include a wheeled arm that may be pivotally coupled to the side panel and may be sized and positioned such that the wheeled arm may rotate through the aperture of the front panel. The wheeled arm may further include an arm member that may have a first end and a second end. The arm member may be pivotally coupled to the side panel, between the first end and the second end. The wheeled arm may include a wheel that may be coupled to the first end of the arm member. The wheeled arm may include an aperture cover that may be coupled to the arm member and may be shaped and positioned such that when the wheeled arm is in a retracted mode, the aperture cover may cover a majority of the aperture, but not substantially all, thereby forming a wheel gap.

The retractable wheel assembly may include a deployment arm that may be coupled to the second end of the arm member. The retractable wheel assembly may include a trap member that may be operationally coupled to the deployment arm. The trap member may include a trap flange that may be sized and positioned to cover the wheel gap when in a closed mode and may substantially uncover the wheel gap in an open mode.

The retractable wheel assembly may include a handle that may be operationally coupled to the trap member. The retractable wheel assembly may include a variably engaging coupling device that may be functionally disposed between the trap member and the wheeled arm, such that actuating the handle, the variably engaging coupling device may engage the trap member sufficient to substantially open the wheel gap and may then afterwards engage the wheeled arm, thereby causing the wheel to be rotated through the aperture while the trap member is retracted.

The wheel assembly may also include a second variably engaging coupling device that may be operationally disposed between the handle and the trap member, thereby creating a two stage deployment handle. The variably engaging coupling device may be a slotted fitting that may have a slot length substantially equal to a length of the wheel gap.

The wheel assembly may include a second wheel assembly that may substantially mirror the first wheeled assembly. Each wheel assembly may share a single trap member that may include a first trap flange and a second trap flange. The wheel assembly may include a wheel rest that may extend orthogonally from an end of the trap flange. The wheel rest may be shaped and positioned to receive a surface of the wheel.

According to one embodiment of the invention, there is a wheeled container that may include a housing. The housing may include a bottom portion that may have a housing aperture disposed therethrough. The housing may include a top housing aperture. The housing may also include a bottom housing aperture.

The wheeled container may include a retractable wheel assembly that may be coupled over the housing aperture. The retractable wheel assembly may include a bracing member that may have a side panel and a front panel that may be coupled to the side panel. The front panel may include an aperture that may be disposed therethrough. The wheel assembly may include a wheeled arm that may be pivotally coupled to the side panel and may be sized and positioned such that the wheeled arm may rotate through the aperture of the front panel. The wheeled arm may include an arm member that may have a first end and a second end. The arm member may be pivotally coupled to the side panel, between the first end and the second end. The wheeled arm may include a wheel that may be coupled to the first end of the arm member. The wheeled arm may include an aperture cover that may be coupled to the arm member and may be shaped and positioned such that when the wheeled arm is in a retracted mode, the aperture cover may cover a majority of the aperture, but not substantially all, thereby forming a wheel gap.

The wheel assembly may include a deployment arm that may be coupled to the second end of the arm member. The wheel assembly may include a trap member that may be operationally coupled to the deployment arm. The trap member may include a trap flange that may be sized and positioned to cover the wheel gap when in a closed mode and to substantially uncover the wheel gap in an open mode. The wheeled container may also include a handle that may extend through the top housing aperture.

The wheeled container may include a variably engaging coupling device that may be functionally disposed between the trap member and the wheeled arm, such that actuating the handle, the variably engaging coupling device may engage the trap member sufficient to substantially open the wheel gap and may then engage the wheeled arm, thereby causing the wheel to be rotated through the aperture.

The wheeled container may include a second variably engaging coupling device that may be operationally disposed between the handle and the trap member, thereby forming a two stage deployment handle. The variably engaging coupling device may be a slotted fitting that may have a slot length substantially equal to a length of the wheel gap. The wheeled container may include a second wheel assembly that may substantially mirror the first wheeled assembly. Each wheel assembly may share a single trap member that may have a first trap flange and a second trap flange. The wheeled container may include a wheel rest extending orthogonally from an end of the trap flange and shaped and positioned to receive a surface of the wheel.

According to one embodiment of the invention. there is a kit for configuring a container with retractable wheels. The kit may include a wheel assembly that may have a bracing member. The bracing member may include a side panel and a front panel that may be coupled to the side panel. The front panel may include an aperture that may be disposed therethrough. The brace member may include coupling devices that may be configured to couple the brace member to a container.

The wheel assembly may include a wheeled arm that may be pivotally coupled to the side panel and may be sized and positioned such that the wheeled arm may rotate through the aperture of the front panel. The wheeled arm may also include an arm member that may have a first end and a second end. The arm member may be pivotally coupled to the side panel, between the first end and the second end. The wheeled arm may include a wheel that may be coupled to the first end of the arm member. The wheeled arm may include an aperture cover that may be coupled to the arm member and may be shaped and positioned such that when the wheeled arm is in a retracted mode, the aperture cover may cover a majority of the aperture, but not substantially all, thereby forming a wheel gap.

The wheeled assembly may include a deployment arm that may be coupled to the second end of the arm member. The wheeled assembly may include a trap member that may be operationally coupled to the deployment arm. The trap member may include a trap flange that may be sized and positioned to cover the wheel gap when in a closed mode and to substantially uncover the wheel gap in an open mode. The wheeled assembly may include a handle that may be operationally coupled to the trap member.

The wheeled assembly may include a variably engaging coupling device that may be functionally disposed between the trap member and the wheeled arm, such that actuating the handle, the variably engaging coupling device may engage the trap member sufficient to substantially open the wheel gap and may then engage the wheeled arm, thereby causing the wheel to be rotated through the aperture.

The kit may also include a plurality of coupling devices that may be configured to facilitate coupling of the wheel assembly to a container. The kit may include a plurality of structural support members that may have coupling devices that may be configured to couple to a container and couple to the wheel assembly. The kit may include a second variably engaging coupling device that may be operationally disposed between the handle and the trap member, thereby forming a two stage deployment handle. The variably engaging coupling device may be a slotted fitting that may have a slot length substantially equal to a length of the wheel gap. The kit may include a second wheel assembly that may have a structure substantially mirroring the first wheeled assembly. The kit may further include a wheel rest that may extend orthogonally from an end of the trap flange and may be shaped and positioned to receive a surface of the wheel.

According to one embodiment of the invention, there is a wheel assembly that may include a bracing member. The bracing member may include a side panel. The bracing member may include a front panel that may be coupled to the side panel and may include an aperture disposed therethrough. The wheel assembly may include a wheeled arm that may be pivotally coupled to the side panel and may be sized and positioned such that the wheeled arm may rotate through the aperture of the front panel.

The wheeled arm may also include an arm member that may include a first end and a second end. The arm member may be pivotally coupled to the side panel, between the first end and the second end. The wheeled arm may include a wheel that may be coupled to the first end of the arm member. The wheeled arm may include an aperture cover that may be coupled to the arm member.

The wheel assembly may include a deployment hub that may be operationally coupled to the wheeled arm such that rotation of the deployment hub may rotate the wheeled arm, between an extended mode and a retracted mode. The wheel assembly may include a cable that may be operationally coupled to the deployment hub and may be wound there about, such that pulling the cable may cause rotation of the deployment hub. The wheel assembly may include a biased assembly that may be operationally coupled to the wheeled arm and may be configured to bias the wheeled arm in a retracted mode.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
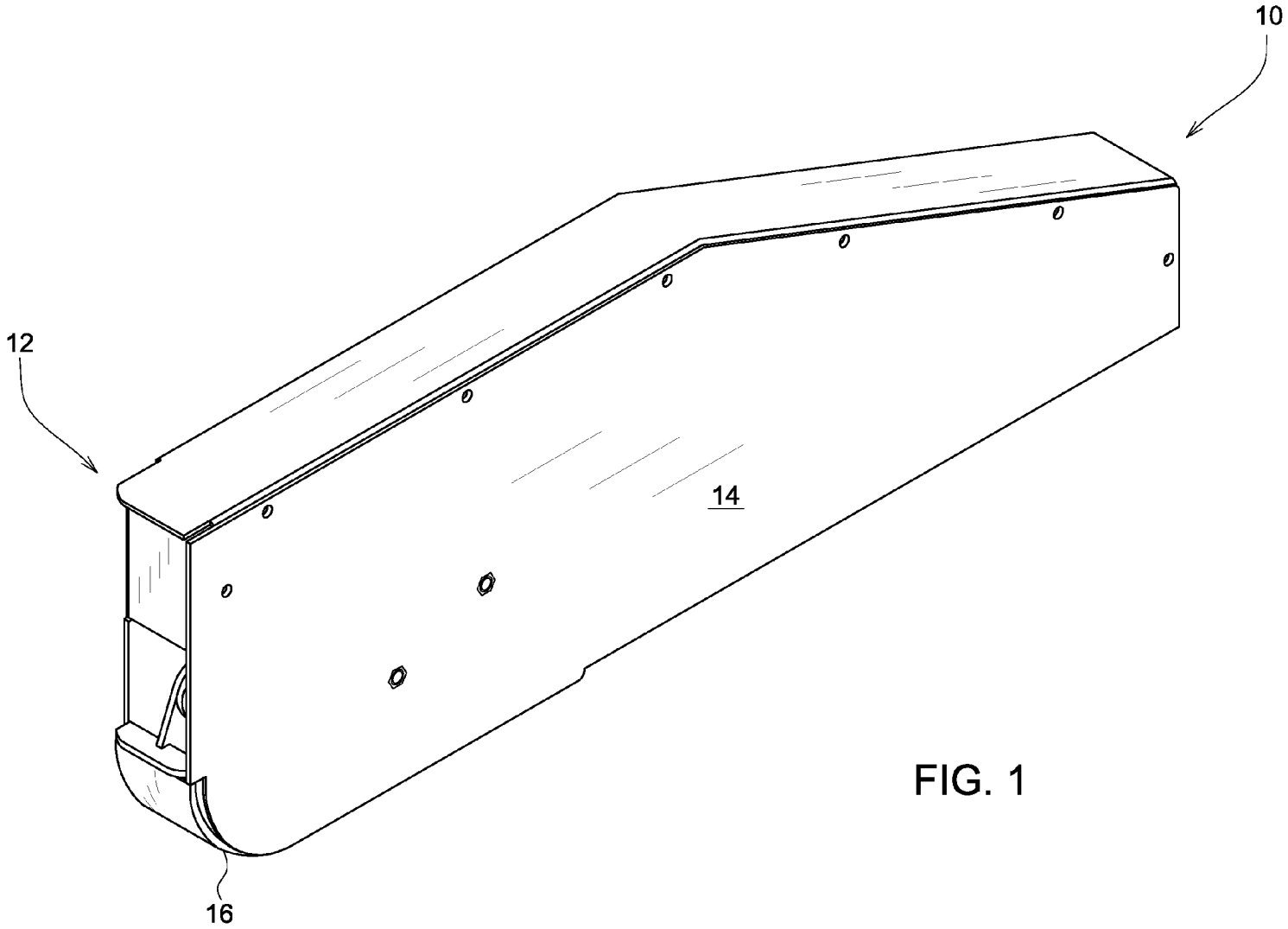
FIG. 1 is a perspective view of a retractable wheel assembly, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a retractable wheel assembly, according to one embodiment of the invention. There is shown a retractable wheel assembly 10 including a bracing member 12 having a side panel 14 coupled to a front panel 16. The illustrated wheel assembly is configured to be selectably mountable in a modified container. Accordingly, any container, sufficiently modified, may be provide with retractable wheels. The wheel assembly is self-contained with a thin profile, thereby taking up only a small amount of space inside a container, while providing a great deal of convenience through a durable and reliable mechanism.

The illustrated retractable wheel assembly 10 is configured to be coupled or attached to a container, such as but not limited to a piece of luggage. The retractable wheel assembly 10 is configured to couple to an interior side wall of a container or extend therethrough and become part of the structural support of a container. The retractable wheel assembly 10 includes a bracing member 12 configured to support the components and parts of the retractable wheel assembly that are disposed therein. The bracing member 12 includes a side panel 14 configured to couple to an interior side wall of a container or may be configured to extend through an interior side wall and become part of an exterior wall of a container and provide support thereto. The bracing member 12 also includes a front panel 16 coupled to the side panel 14, wherein the front panel 16 and the side panel 14 complete a substantial enclosure for the components and parts of the retractable wheel assembly 10. The front panel 16 includes an aperture disposed on a bottom surface of the retractable wheel assembly 10, sized and shape for a retractable wheel to rotate therethrough.

Advantageously, even large/heavy containers may be outfitted with one or more wheel assemblies that may operate independently or simultaneously as desired to provide wheeled motion to the container. Having retractable wheels permits transport of containers by fewer people, often just requiring a single person. The containers may still be stacked without difficulty and without risk of damage to the wheels. This is particularly critical in industries where large amounts of materials are stored and utilized repeatedly or where such must be deployed rapidly. Common situations include but are not limited to human logistics operations, inventory management/deployment, rescue events, and the like.

Figure 2:
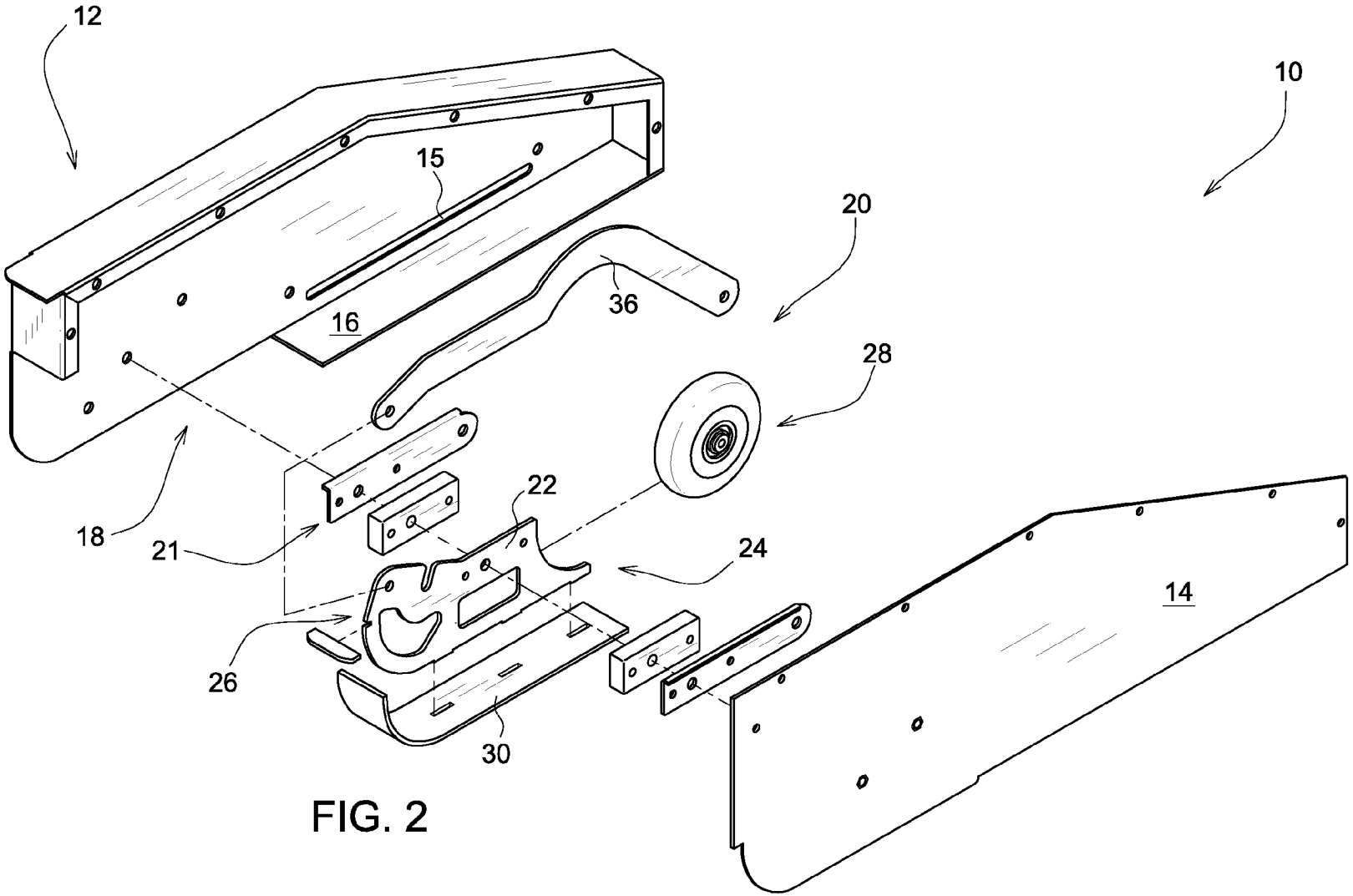
FIG. 2 is an exploded view of a retractable wheel assembly, according to one embodiment of the invention.

FIG. 2 is an exploded view of a retractable wheel assembly, according to one embodiment of the invention. There is shown a retractable wheel assembly 10 including a bracing member 12 and a wheeled arm 20.

The illustrated retractable wheel assembly 10 includes a bracing member 12 having a side panel 14 and a front panel 16. The front panel 16 is configured to be coupled to the side panel 14 and when coupled together creates an aperture 18 sized and shaped for a wheel 28 to pass therethrough. The bracing member 12 is configured to provide structural support to the components and parts of the retractable wheel assembly 10 that are disposed therein. As illustrated, the front panel 16 includes a side panel member, a top panel member, and a bottom panel member configured to provide an enclosure to the retractable wheel assembly 10.

The retractable wheel assembly 10 includes a wheeled arm 20 pivotally coupled to the side panel 14. The wheeled arm 20 is sized and positioned such that during deployment, the wheeled arm 20 rotates through the aperture 18 of the front panel 16. During retraction, the wheeled arm 20 rotates back through the aperture 18 and into the enclosure created by the front panel 16 and the side panel 14 of the bracing member 12. The wheeled arm 20 includes an arm member 22 having a first end 24 and a second end 26. The arm member 22 is configured to be pivotally coupled to the side panel 14, between the first end 24 and the second end 26. The wheel 28 is coupled to the first end 24 of the arm member 20. The retractable wheel assembly 10 includes a deployment arm 36 coupled to the second end 26 of the arm member 22. The deployment arm 36 is configured to actuate the deployment and retraction of the wheeled arm 20.

Figure 7:
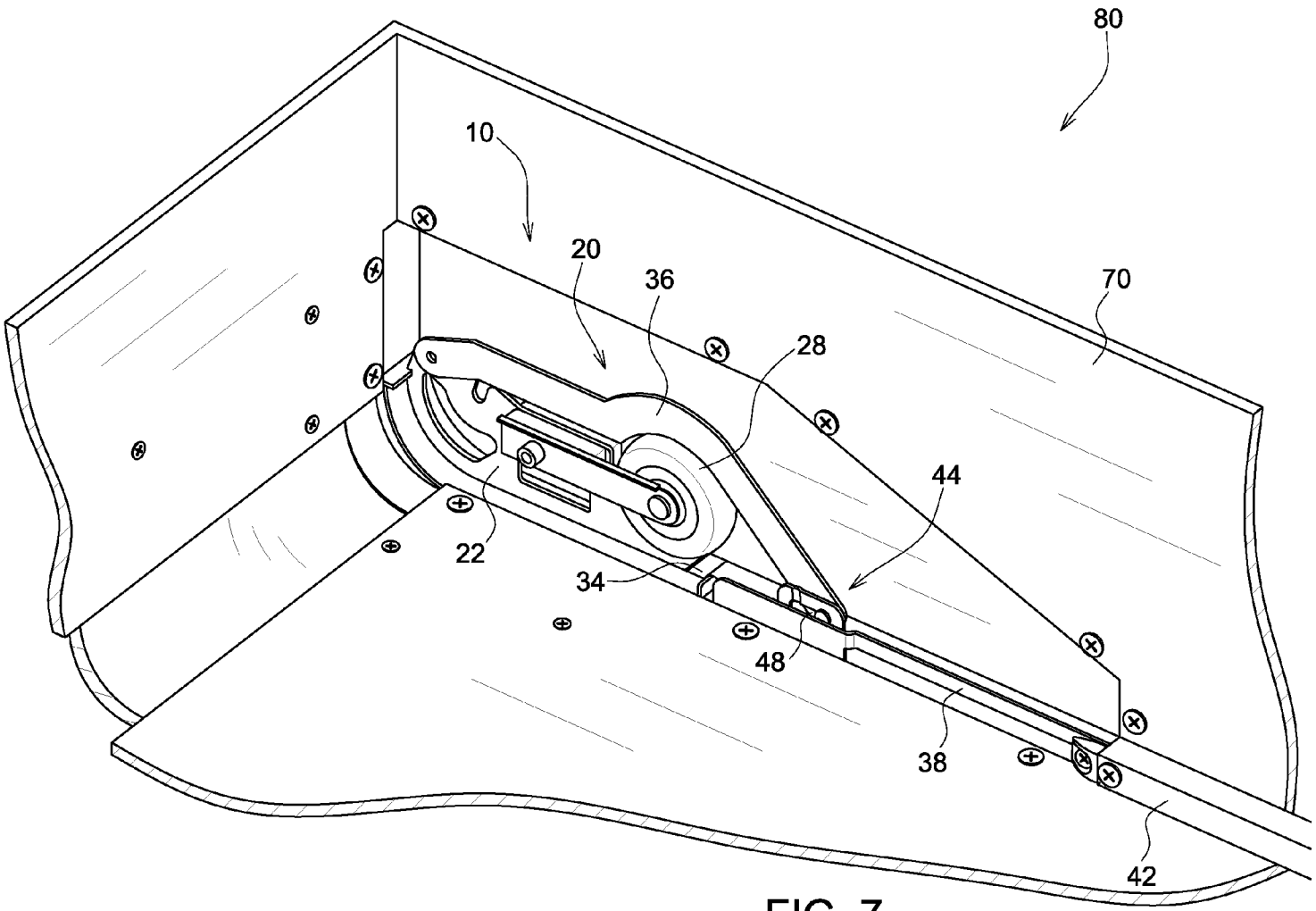
FIG. 7 is a partial cross-sectional perspective view of a container including a retractable wheel assembly coupled to an interior thereof, according to one embodiment of the invention.

As illustrated, the wheeled arm 20 includes a plurality of support structures 21 configured to couple the wheel 28 to the arm member 22 and provide structural support thereto. The wheeled arm 20 also includes an aperture cover 30 coupled to the arm member 22 and the support structures 21. The wheeled arm 20, the plurality of support structures, and the aperture cover 30 may be configured in one single piece and still perform its intended function. The aperture cover 30 is shaped and positioned such that when the wheeled arm 20 is in a retracted mode, the aperture cover 30 covers a majority of the aperture 18 of the front panel 16, but not substantially all, thereby forming a wheel gap. The wheel gap, see FIG. 7, is configured to allow the wheel 28 to rotate therethrough without contacting the front panel 16 or side panel 14 of the bracing member 12.

Figure 3:
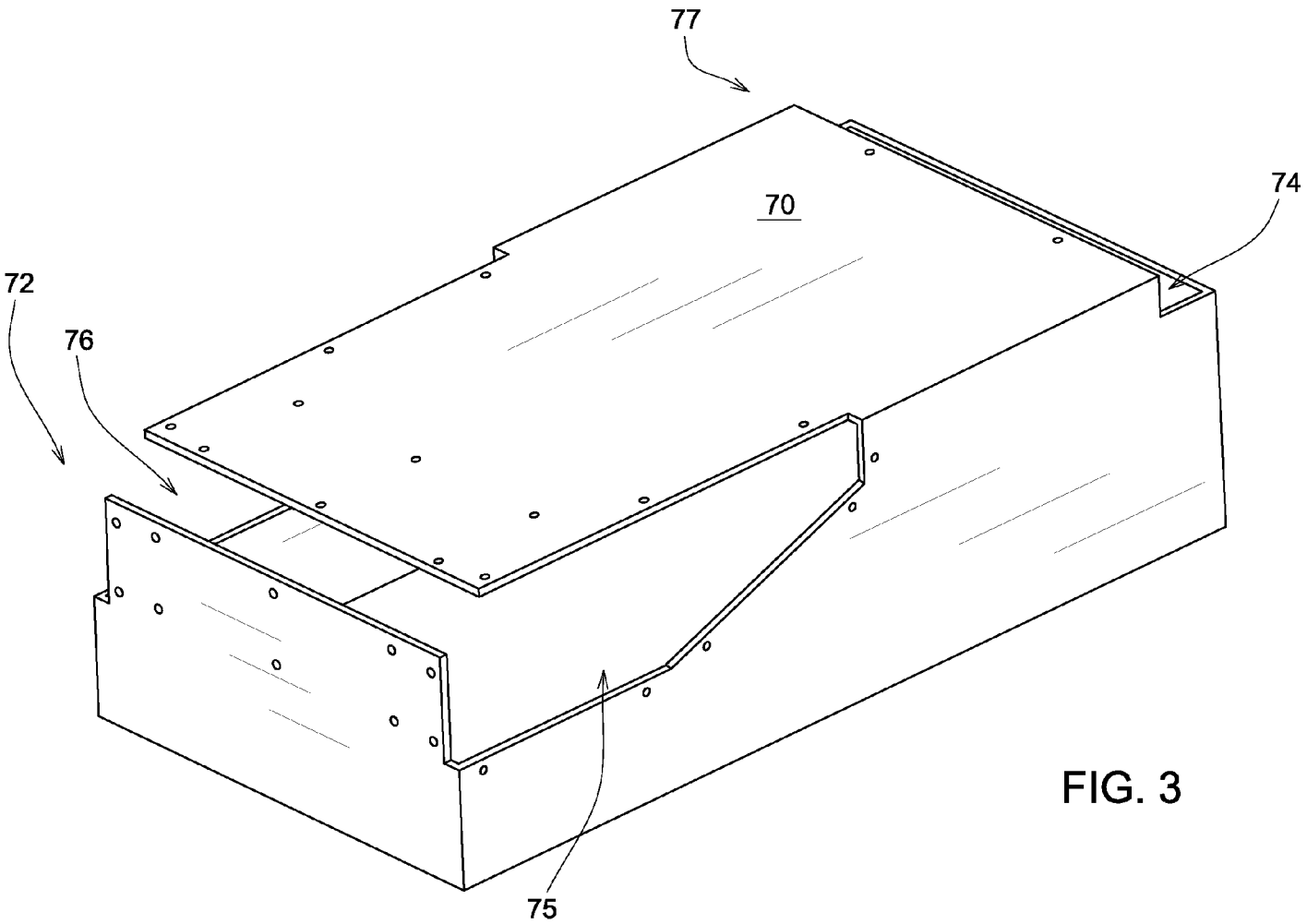
FIG. 3 is a perspective view of a modified housing, according to one embodiment of the invention.

FIG. 3 is a perspective view of a modified housing/container, according to one embodiment of the invention. There is shown a modified housing 70 including a bottom portion 72 having a bottom housing aperture 76 and a top portion 77 having a top housing aperture 74. The illustrated container is a rectangular box. The box has been modified by removing portions selected and sized to permit installation of a pair of wheel assemblies plus a handle and its associated mechanisms. Further, portions expected to receive extra stress during use have been removed to permit them to be replaced by stronger materials. This is not always necessary, but wherein containers are filled with materials that weight close to the intended operational thresholds of the containers it may be necessary to strengthen such portions.

The illustrated modified housing 70 is configured to be retrofitted to receive a pair of retractable wheel assemblies and a handle, thereby providing mobility to a container that is typically difficult to move. The modified housing 70 includes a bottom portion 72 having a bottom housing aperture 76 disposed therethrough. The bottom housing aperture 76 includes a pair of side apertures 75 configured to receive a retractable wheel assembly therethrough. The retractable wheel assembly is configured to be disposed through the housing aperture 75 and is configured to extend therethrough. The housing apertures 75 are configured to receive a retractable wheel assembly on each side of the modified housing 70, thereby providing stable mobility while moving the modified housing 70. The bottom housing aperture 76 is also configured to receive a plurality of structural supports configured to couple to each of the pair of retractable wheel assemblies and provide support thereto. The plurality of structural supports are also disposed between the pair of retractable wheel assemblies to also provide structural stability to the modified housing 70 during use. The housing 70 includes a top portion 77 having a top housing aperture 74 configured to receive a support structure and a handle. The handle is configured to couple to each of the retractable wheel assemblies within the modified housing 70. The handle is configured to extend or retract within the modified housing 70, thereby either retracting or deploying the retractable wheel assemblies during use.

Figure 4:
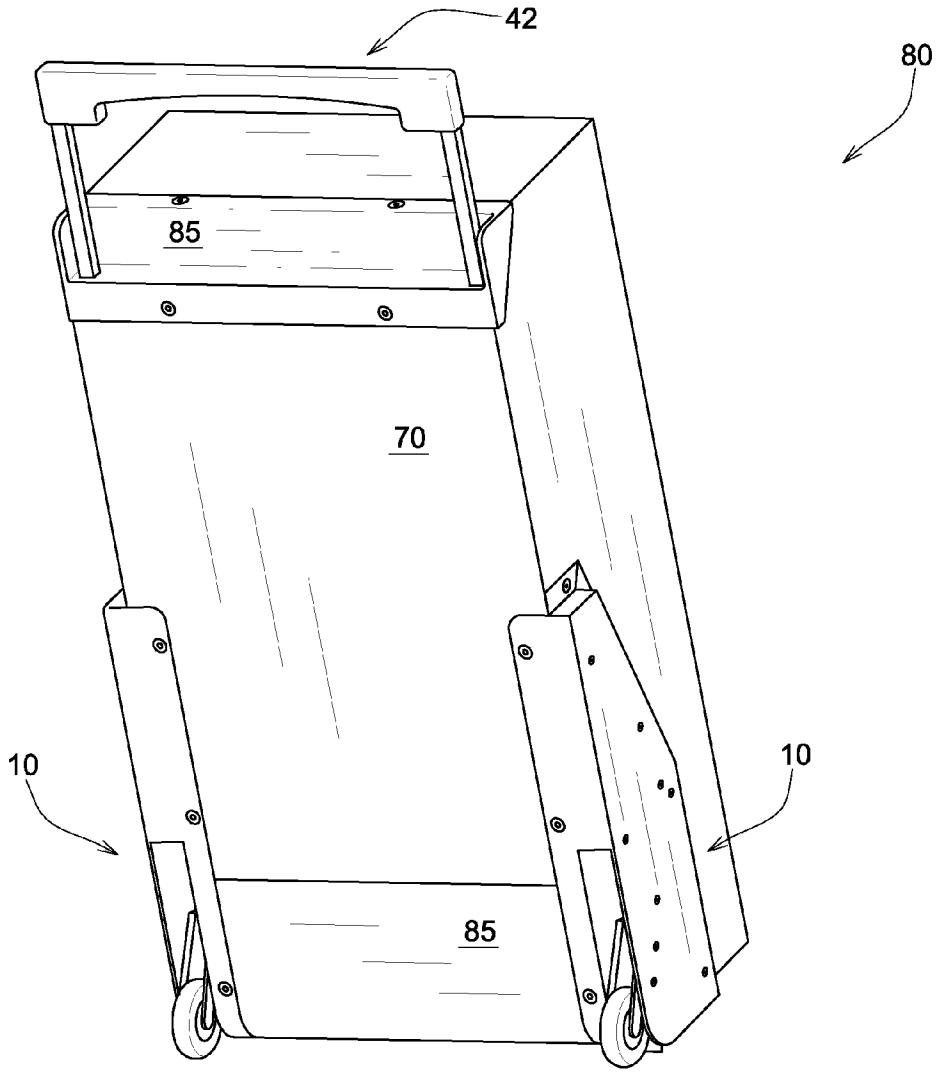
FIG. 4 is a perspective view of a wheeled container, according to one embodiment of the invention.

FIG. 4 is a perspective view of a wheeled container, according to one embodiment of the invention. There is shown a wheeled container 80 including a modified housing 70, a pair of retractable wheel assemblies 10, and a handle 42.

The illustrated wheeled container 80 includes a modified housing 70 configured to be retrofitted to receive a pair of retractable wheel assemblies 10 and a handle 42. The modified housing 70 may include a hard shell and a soft shell coupled together to form the modified housing 70. The hard shell may be configured to support the pair of retractable wheel assemblies 10 and the handle 42 and the soft shell, configured to be coupled to the hard shell, may include pockets and the like, to store personal items outside of the main interior portion of the modified housing 70. The pair of retractable wheel assemblies 10 and the handle 42 are coupled to the modified housing by a plurality of support structures 85 configured to provide structural support to the wheel assemblies 10 and to the handle 42 during use. The housing 70 includes a bottom housing aperture having a pair of side apertures sized and shaped to each receive a retractable wheel assembly 10 therein. The retractable wheel assembly 10 is configured to be coupled over the side apertures and extend through a side wall of the modified housing 70. The modified housing 70 is configured to receive a retractable wheel assembly 10 on each side thereof, thereby providing mobility to the wheeled container 80.

The modified housing 70 includes a plurality of structural support members 85 configured to support each retractable wheel assembly, the handle 42, and the modified container 70. The structural supports 85 may include plates, brackets, coupling devices, anchors, etc. to provide support to the retractable wheel assemblies 10, the handle 42. In addition, the plurality of structural supports 85 are also configured to provide additional structural support to the modified housing 70 during use. The modified housing 70 includes a top housing aperture configured to receive a support structure 85, wherein the handle 42 is configured to extend and retract therethrough. The support structure 85 is sized and shaped to receive the handle 42. The support structure 85 is configured to support the handle 42 during use, and also support a top portion of the modified container 70.

In one non-limiting embodiment, there is a heavy duty cartridge (wheel assemblies) designed primarily for heavy duty containers and/or designed in such a way to accommodate consumer products that are very heavy, such as appliances. Such may also be used for larger travel luggage, boxes, trunks, and etc. In such an embodiment, the operating mechanism for wheel deployment is a pull to open and a push to close. The wheel assembly is embodied as a cartridge that can be used independently or may be used in pairs or other groupings. Such a cartridge may include parts comprised of metal, plastics, composites and etc. Such a cartridge may be constructed as an injected molded piece, where the exterior casing may be a single unit. Cartridges may be installed and/or retrofitted into existing containers in parallel sets, inline sets (like inline wheels on rollerblades), and/or in unmatched sets for irregular containers and/or tracks/walkways/paths, and/or in any combination thereof. Having a plurality of cartridges that may have different sizes and other characteristics allows such to be deployed in infinite variety and permits containers of infinite variety to have deployable wheels.

In one non-limiting embodiment, the weight factor (or weight allowance per cartridge) may be highly dependent on the strength rating of a pivot pin about which a wheel arm pivots. The weight of a container, at full wheel deployment, will generally be distributed amongst wheel assemblies and, within each wheel assembly, between pivot pin and the fully deployed wheel arm resting against the product itself. Accordingly, such a wheel assembly, because weight is distributed (fairly equally in some embodiments) between pin and the container itself (through the wheel arm), the overall weight allowance of the system is larger than the mere sum of the pin ratings. This advantageously permits wheel assemblies to operate more effectively, with greater durability and under a wider variety of usage limits.

Such containers and other structures/devices may be processed aftermarket (by retrofitting) or before market (during construction, design, assembly, etc.) to include one or more of the illustrated/described cartridges. Cartridge deployment may be independent or may be simultaneous/coupled deployment mechanisms, such as but not limited to using a shuttle or yoke. To prevent movement of the wheels when in a stowed position, the deployment bracket is designed with an additional travel that fully closes the opening after the wheel is retracted and at the same time moves a seat (trap member) that wedges with the wheel preventing movement of the wheel when retracted. The wheel mechanism cannot be manually deployed in the locked position without properly deploying the mechanism. As an example, force applied against the wheel arm, such as but not limited to the wheel arm catching against an outside object, would not generally cause the wheel to deploy. This helps prevent damage to the wheel assembly and to the associated container as well. Further, vibration during flight (or otherwise) or handling does not generally cause the wheel to extend as may happen without the seat/trap member. The illustrated seat includes a slotted coupling connected to the main shuttle that permits the main shuttle to move a predefined amount without activating/engaging the seat in motion. This permits the wheel to completely retract before the seat then engages against the wheel and it also permits the seat to move out of the way prior to movement of the wheel.

Figure 5:
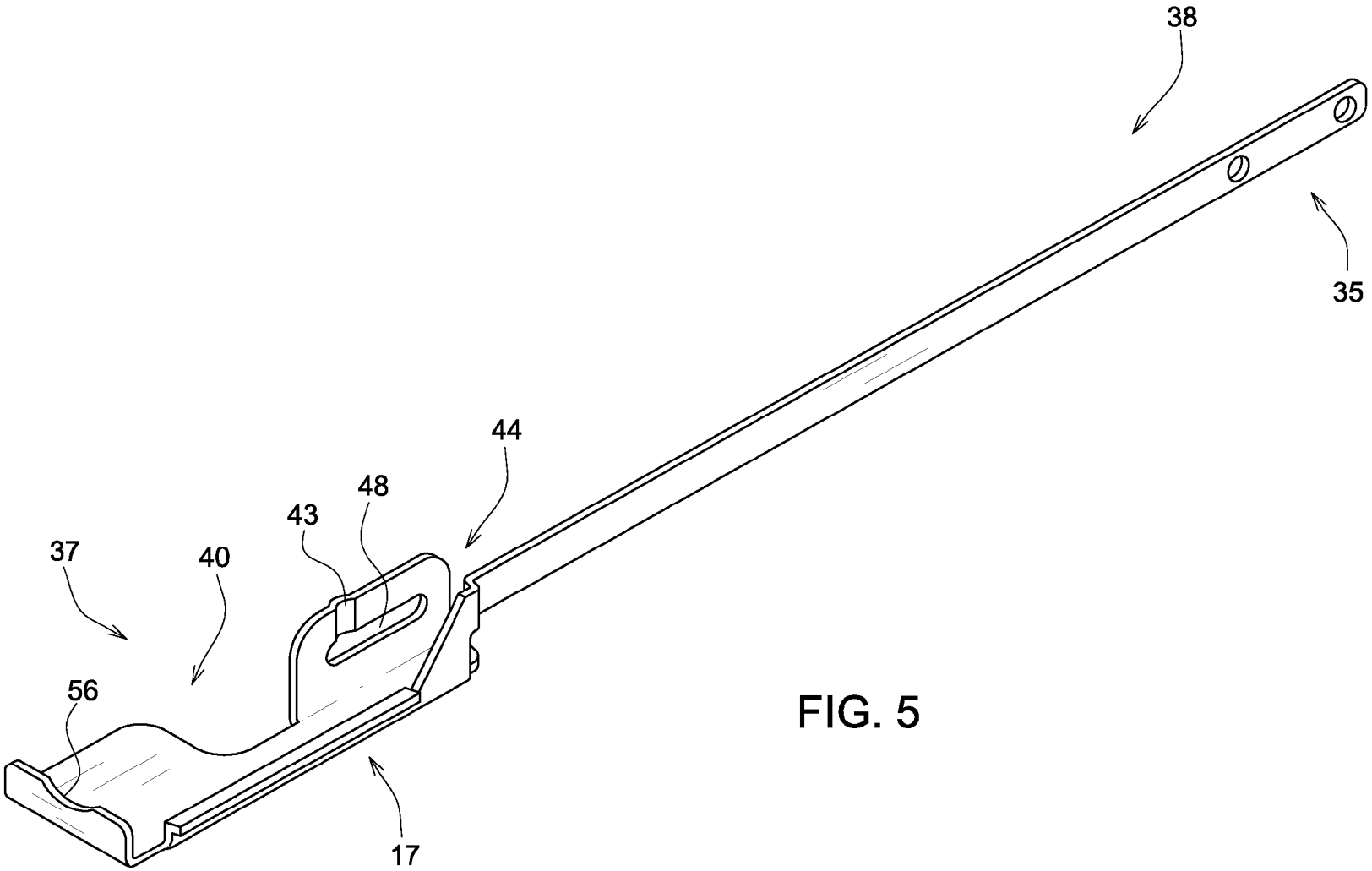
FIG. 5 is a perspective view of a trap member of a retractable wheel assembly, according to one embodiment of the invention.

FIG. 5 is a perspective view of a trap member of a retractable wheel assembly, according to one embodiment of the invention. There is shown a trap member 38 having a variably engaging coupling device 44.

The illustrated trap member 38 includes a structure sufficient to couple a trap flange 40 to a variably engaging coupling device 44 and permit the trap member 38 to be coupled to some kind of "handle" configured to permit a user to operate the same. In particular, the structure allows "pulling the handle" to cause the trap flange 40 to disengage from its "trapping" position before the variably engaging coupling device 44 is engaged sufficiently to cause motion of the handle to be transferred to whatever is coupled to the variably engaging coupling device 44. Accordingly, the trap flange 40 moves out of the way before anything else further in the chain of operation moves.

The illustrated variably engaging coupling device 44 is a slotted ring 48, wherein the illustrated slot 48 is sized and positioned in alignment with the direction of motion of the trap member 38. Accordingly, the slot 48 does not engage an attached member in motion with the trap member 38 until a coupling pin (or other coupling structure) of the attached member slides up against a securement loop 43 of the slot 48. Other variably engaging coupling devices may be used with the defining criteria being that such coupling devices permit the coupled members to move relative to each other within certain defined boundaries, at which boundaries the two members then move in unison.

Non-limiting examples include spring systems with defined threshold(s) and step-like responses to reaching such threshold(s), telescoping rails with catch points that restrict further telescopic movement at a defined point, scissor couplings (similar to scissor lifts) that permit relative motion within the range of motion of the scissor mechanism, paired flexible cablings coupled to opposite positions, singular cablings coupled to a fixed point, and the like and combinations thereof.

The illustrated trap member 38 includes a first end 35 and a second end 37. The first end 35 of the trap member 38 is configured to couple to a handle of a wheeled container. The second end 37 of the trap member 38 is operationally coupled to a deployment arm of a retractable wheel assembly. The trap member 38 includes a trap flange 40 sized and positioned to cover a wheel gap, when a retractable wheel assembly is in a retracted mode. The trap flange 40 is also configured to substantially uncover a wheel gap when a retractable wheel assembly is in a deployed mode. The wheel gap is covered to provide a secure enclosure for the components and parts of the retractable wheel assembly, not providing a cover to the wheel gap may damage or break the components and parts of the retractable wheel assembly during use.

The trap member 38 includes a variably engaging coupling device 44 functionally disposed between the trap member 38 and a wheeled arm of a retractable wheel assembly. Actuating a handle of a wheeled container, engages the variably engaging coupling device 44 with the trap member 38, sufficient to substantially open a wheel gap and then afterwards engages the wheeled arm, thereby causing the wheel to rotate through the aperture while the trap member 38 is retracted. The variably engaging coupling device includes a slotted fitting 48 having a slot length substantially equal to a length of the wheel gap. The slotted fitting 48 is configured to enable movement of the trap flange 40 to uncover the wheel gap before the variably engaging coupling device actuates the wheeled arm and deploys the retractable wheel assembly. The slotted fitting 48 includes a securement loop 43 configured to engage a deployment arm coupled to an arm member of a wheeled arm and secure thereto while the retractable wheel assembly is in a deployed mode. The securement loop 43 is configured to support the deployment arm and the arm member in a locked position while the retractable wheel assembly is in a deployed mode and configured to disengage from the deployment arm, once pressure is applied to the handle, thereby retracting the retractable wheel assembly and the handle into a housing. The arm member is configured to disengage the securement loop 43 and move along the slotted fitting 48 until the retractable wheel assembly is in a retracted mode. The trap member 38 includes a wheel rest 56 extending orthogonally from an end of the trap flange 40 and shaped and positioned to receive a surface of a wheel.

The trap member 38 includes a lip 17 configured to travel along a slit of a side panel of a bracing member of a retractable wheel assembly. The lip 17 is configured to extend from the trap member is an L-shaped configuration, wherein the lip 17 extends upwardly and then outwardly away from the trap flange 40. The lip 17 is configured to guide the trap member 38 in a linear movement when the retractable wheel assembly is either deployed or retracted. The lip 17 is sized and shaped to slide within a slit of the side panel of a bracing member. (See FIG. 2, slit 15, though for illustration purposes the trap member of FIG. 5 is non-matching to the assembly of FIG. 2, while the non-illustrated paired trap member would be matching).

Figure 6:
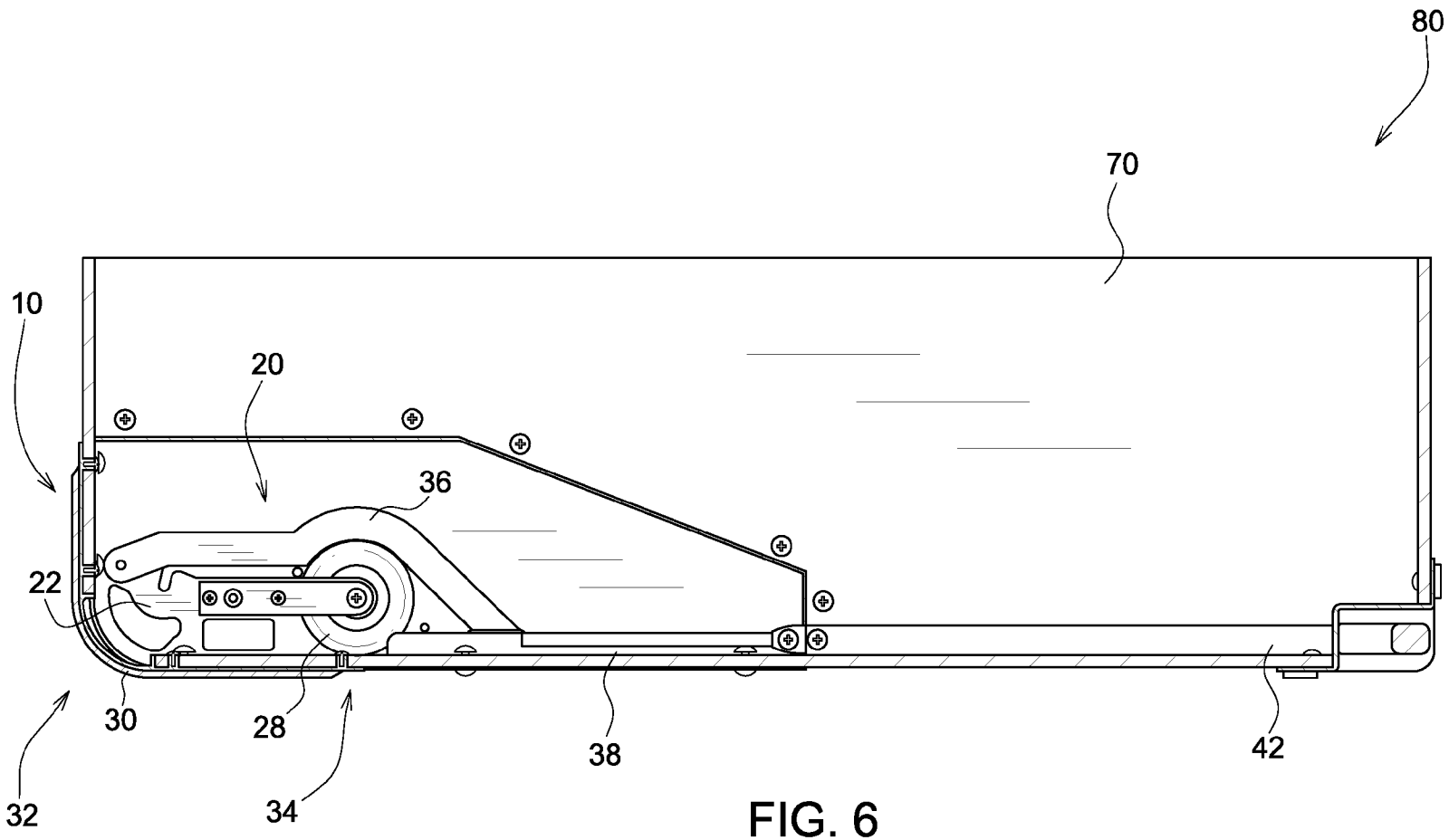
FIG. 6 is a side cross-sectional view of a wheeled container, according to one embodiment of the invention.

FIG. 6 is a side cross-sectional view of a wheeled container, according to one embodiment of the invention. There is shown a wheeled container 80 including a modified housing 70, a retractable wheel assembly 10, a handle 42, a deployment arm 36, and a trap member 38.

The illustrated wheeled container 80 includes a modified housing 70 configured to support the contents and components of the wheeled container 80. The wheeled container 80 includes a handle 42 configured to extend and retract through a top portion of the modified housing 70. The handle 42 is functionally coupled to a trap member 38 within the modified housing 70. The trap member 38 is operationally coupled to a deployment arm 36. The deployment arm 36 is operationally coupled to an arm member 22 of a wheeled arm 20. The wheeled arm 20 is disposed within a retractable wheel assembly 10 configured to retract and deploy a wheel 28 therefrom. The wheeled arm 20 includes an aperture cover 30 coupled to the arm member 22 and shaped and positioned such that when the wheeled arm 20 is in a retracted mode 32, the aperture cover 30 covers a majority of an aperture, but not substantially all, thereby forming a wheel gap 34. The trap member 38 includes a trap flange sized and positioned to cover the wheel gap 34 when in a retracted mode 32 and to substantially uncover the wheel gap 34 in a deployed mode.

FIG. 7 is a partial cross-sectional perspective view of a container including a retractable wheel assembly coupled to an interior thereof, according to one embodiment of the invention. There is shown a wheeled container 80 having a modified housing 70, a handle 42, a deployment arm 36, a trap member 38, and a wheeled arm 20.

The illustrated wheeled container 80 includes a modified housing 70 configured to support a retractable wheel assembly 10. The retractable wheel assembly 10 is configured to couple to an interior wall of the modified housing 70 and extend therethrough. The wheeled container 80 includes a handle 42 configured to extend and retract in and out of a top portion of the modified housing 70. The handle 42 is functionally coupled to a trap member 38 configured to actuate the wheeled arm 20 when extended or retracted from the modified housing 70. The trap member 38 is operationally coupled to a deployment arm 36. The deployment arm 36 is operationally coupled to an arm member 22 of a wheeled arm 20. The wheeled arm 20 is disposed within a retractable wheel assembly 10 configured to deploy and retract a wheel 28 therefrom.

The retractable wheel assembly 10 includes a variably engaging coupling device 44 functionally disposed between the trap member 38 and the deployment arm 36, such that actuating the handle 42, the variably engaging coupling device 44 engages the trap member 38 sufficient to substantially open a wheel gap 34 and then afterwards engages the wheeled arm 20, thereby causing the wheel 28 to be rotated through an aperture while the trap member 38 is retracted. The variably engaging coupling device 44 includes a slotted fitting 48 having a slot length substantially equal to a length of the wheel gap 34. The slotted fitting 48 is configured to displace the trap member 38 to a specified length so the wheel 28 is not obstructed when retracting and deploying from the modified housing 70.

Figure 8:
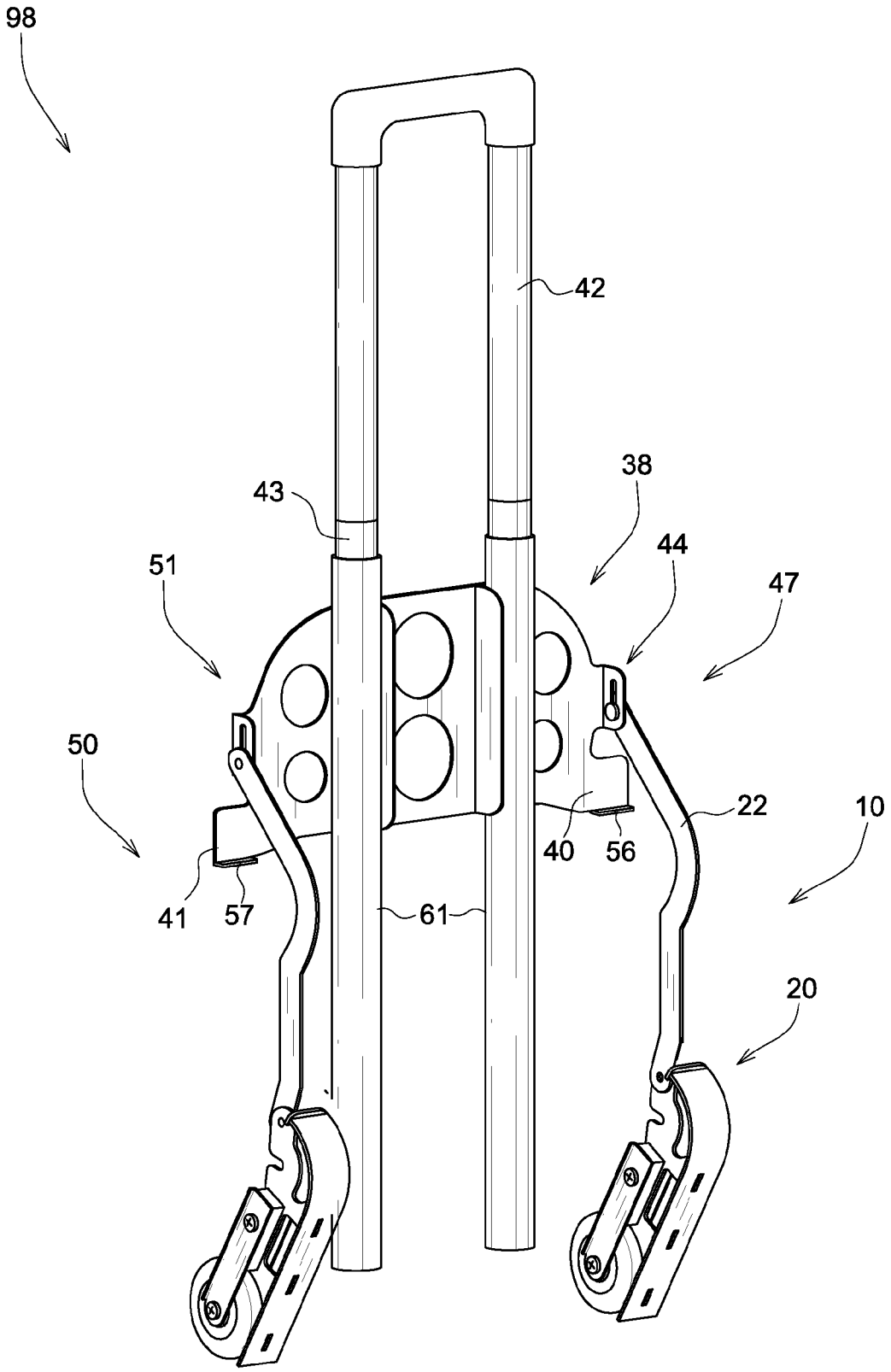
FIG. 8 is a perspective view of a pair of retractable wheel assemblies coupled by a shuttle-trap member, according to one embodiment of the invention.

FIG. 8 is a perspective view of a pair of retractable wheel assemblies coupled by a shuttle-trap member, according to one embodiment of the invention. There is shown a retractable wheel device 98 including a first retractable wheel assembly 10 and a second retractable wheel assembly 50, a trap member 38, and a handle 42.

The illustrated trap member 38 functions both as a shuttle and as a combined set of trap flanges that operate together with different wheel assemblies. Accordingly, the illustrated trap member allows for simultaneous deployment and retraction of the wheels of the wheel assemblies so coupled with a single motion from a user.

The illustrated retractable wheel device 98 is configured to be disposed within a container and extending out therefrom. The retractable wheel device 98 is configured to provide wheeled movement to the container. The retractable wheel device 98 includes a handle 42 coupled to a trap member 38. The trap member 38 includes a first trap flange 40 and a first wheel rest 56 disposed on a first end 47 of the trap member 38. The trap member 38 is coupled to an arm member 22 of a first retractable wheel assembly 10 about the first end 47 of the trap member 38. The first retractable wheel assembly 10 is coupled to the first end 47 of the trap member 38 by a variably engaging coupling device 44.

The illustrated trap member 38 also includes a second trap flange 41 and a second wheel rest 57 disposed on a second side 51 of the trap member 38, opposite of the first side 47 of the trap member 38. The second side 51 of the trap member 38 is configured to couple to a second retractable wheel assembly 50, disposed opposite of the first retractable wheel assembly 10. The second retractable wheel assembly 50 is sized and positioned to mirror the first retractable wheel assembly 10. The trap member 38 is configured to couple to both the first retractable wheel assembly 10 and the second retractable wheel assembly 50.

The handle 42, when actuated operates both the first retractable wheel assembly 10 and the second retractable wheel assembly 50 at the same time. The illustrated handle is coupled to the trap member by a pair of telescopic shafts, such being a second variably engaging coupling device 43 operationally disposed between the handle and the trap member, thereby creating a two stage deployment handle. In particular, when the handle is pulled by the user, the telescopic shafts extend until they reach a point of maximum extension. Then the lower shafts pull against the trap member, causing the trap member to move. Ideally, the deployment length of the telescopic shafts is configured such that it makes up the difference between the total amount of extension desired for the handle to reach an operational height and the total amount of travel required by the wheel assembly to fully deploy. Accordingly, the handle travels the difference first, and then engages the wheel assembly to then cause travel sufficient to fully deploy the wheel(s). When complete, the handle is positioned at a desired height for the user to then operate the container, generally pulling the same behind themselves.

The first retractable wheel assembly 10 and the second retractable wheel assembly 50 are coupled to a trap member 38. The trap member 38 is coupled to a pair of guide members 61 of the handle 42. The handle 42 is configured to actuate an arm member 22 of a wheeled arm 20 of each of the first retractable wheel assembly 10 and the second retractable wheel assembly 50. The first retractable wheel assembly 10 and the second retractable wheel assembly 50 each include a variably engaging coupling device 44 functionally disposed between the trap member 38 and the arm member 22 of the wheeled arm 20. The variably engaging coupling device 44 is configured to facilitate movement of a trap flange 40 of the first retractable wheel assembly 10 and the second retractable wheel assembly 50, thereby allowing a wheel 28 of the wheeled arm 20 to retract and deploy from a container.

Figure 9:
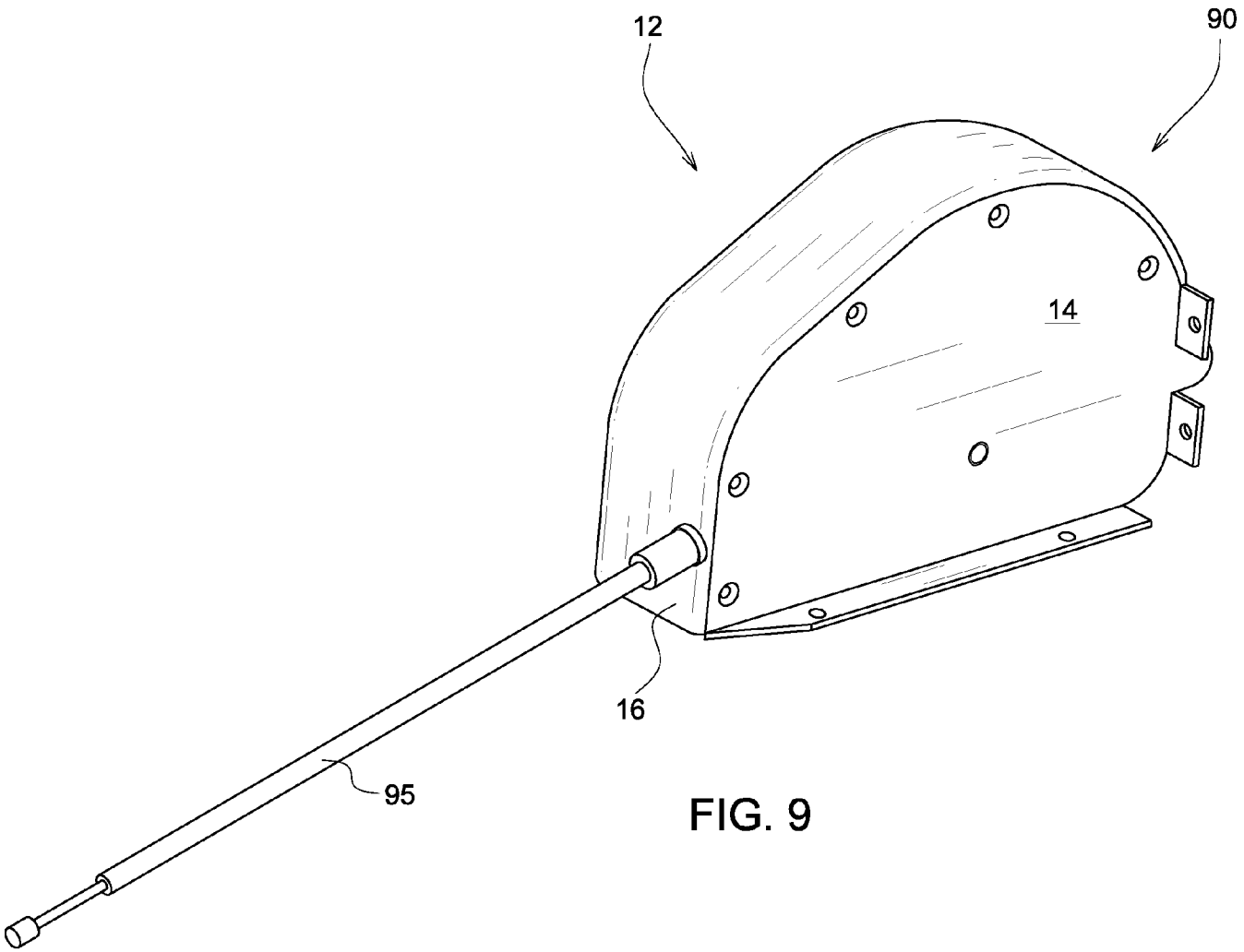
FIG. 9 is a perspective view of a wheel assembly, according to one embodiment of the invention.

FIG. 9 is a perspective view of a wheel assembly, according to one embodiment of the invention. There is shown a wheel assembly 90 including a bracing member 12 having a side panel 14 and a front panel 16, and a cable 95.

The illustrated wheel assembly 90 is configured to be disposed within a container, thereby providing wheeled movement thereto. The wheel assembly 90 includes a bracing member 12 configured to support the components and devices of the wheel assembly 90 therein. The bracing member 12 includes a side panel 14 configured to couple to an interior side wall of a container. The bracing member 12 includes a front panel 16 coupled to the side panel 14 and including an aperture configured for a wheel to rotate therethrough. The wheel assembly 90 includes a cable 95 extending out from the bracing member 12 and configured to couple to a handle of a wheeled container. The cable 95 is configured to actuate the wheel assembly 90 to deploy and retract a wheel therefrom when the handle is extended or retracted from the wheeled container.

In one non-limiting embodiment, there is a light duty cartridge (wheel assembly) designed specifically for personal luggage and smaller containers. Such may be specifically designed to be cost effective in manufacturing, given the intended use. Such a cartridge allows for use in presently existing products with minimal changes to their manufacturing processes and costs. In particular, it may have the same or a similar basic/general movement as the heavy duty cartridge described previously herein, but includes a mechanism based on a torsion spring on one side and a hub having a wound cable (such as but not limited to aircraft cable) on the other. In such an embodiment, a winding distance (generally the circumference of the hub times the number of windings) provides the pull length. In the illustrated example (See FIGS. 10 and 11), a winding distance is about 60-80% of the circumference of the hub. Weight distribution is similar to that found in the previously described heavy duty cartridge.

In one non-limiting embodiment, aircraft cable is connected to a telescopic handle of the luggage. The telescopic handle is slotted and the cable is coupled to the handle at the slot in a manner that permits the coupled end of the cable to travel freely along the slot. The slot is sized and positioned such that the cable can travel freely along the slot except for the final pull amount substantially equal to the winding distance so that the final pull amount turns the hub an appropriate amount and causes the cartridge to deploy. Accordingly, a user may pull a retractable handle which then causes the cartridge to deploy its wheels only as the final length of the retractable handle is withdrawn. As the handle is allowed to return to a stored position, the torsion spring of the assembly turns the wheel arm, thereby retracting the wheels back into the assembly.

Figure 10:
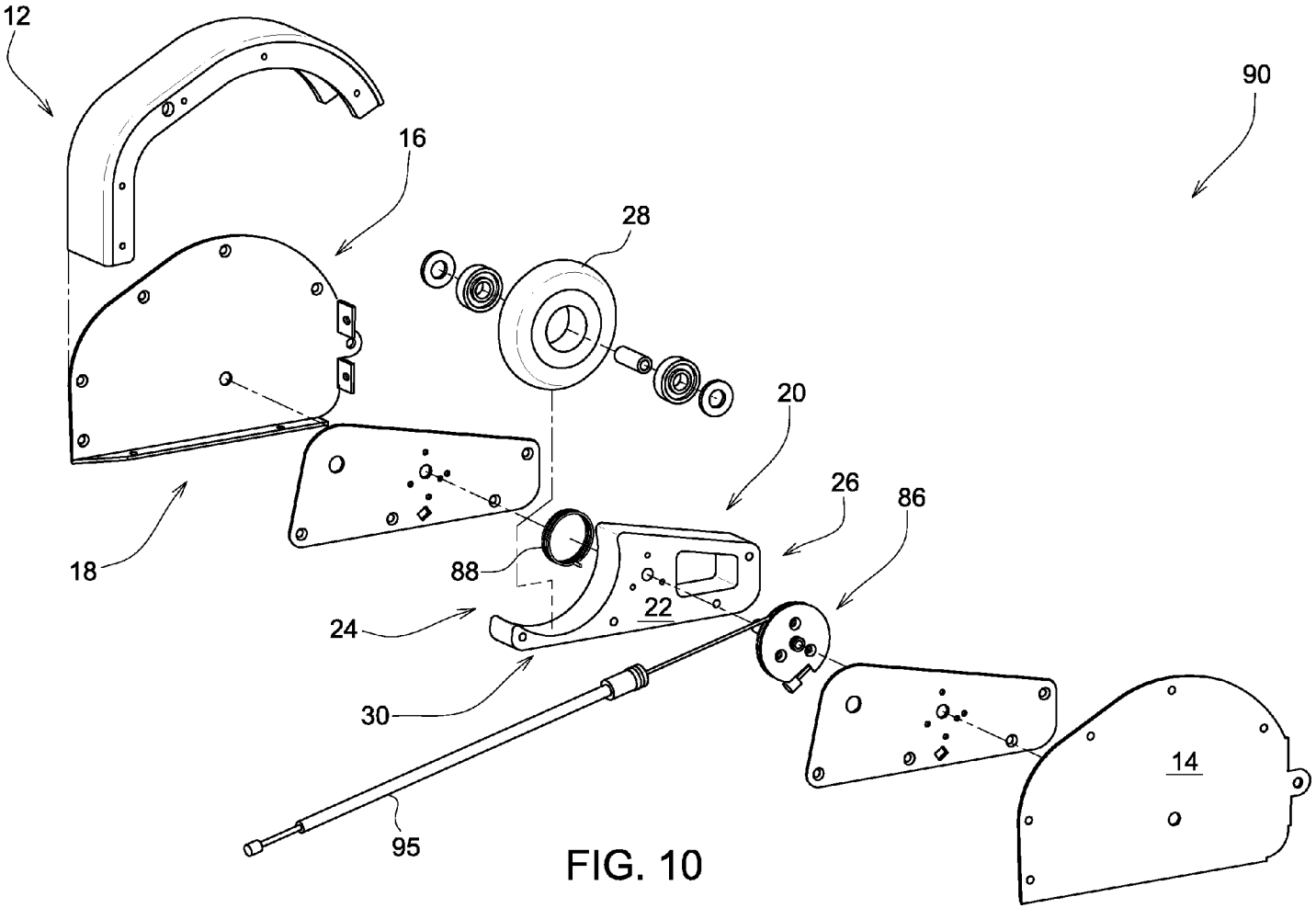
FIG. 10 is an exploded view of a wheel assembly, according to one embodiment of the invention.

FIG. 10 is an exploded view of a wheel assembly, according to one embodiment of the invention. There is shown a wheeled assembly 90 having a bracing member 12, a wheeled arm 20, a deployment hub 86, a cable 95, and a biased member 88.

The illustrated wheel assembly 90 includes a bracing member 12. The bracing member 12 includes a side panel 14. The bracing member 12 includes a front panel 16 configured to couple to the side panel 14. The front panel 16 includes an aperture 18 disposed therethrough. The wheel assembly 90 includes a wheeled arm 20 configured to be pivotally coupled to the side panel 14. The wheeled arm 20 is sized and positioned such that the wheeled arm 20 is configured to rotate through the aperture 18 of the front panel 16 in a deployed mode.

The wheeled arm 20 includes an arm member 22 that includes a first end 24 and a second end 26. The arm member 22 is pivotally coupled to the side panel 14, between the first end 24 and the second end 26. The wheeled arm 20 includes a wheel 28 coupled to the first end 24 of the arm member 22. The wheeled arm 20 includes an aperture cover 30 coupled to the arm member 22.

The wheel assembly 90 includes a deployment hub 86 operationally coupled to the wheeled arm 20 such that rotation of the deployment hub 86 rotates the wheeled arm 20, between an deployed mode and a retracted mode. The wheel assembly 90 includes a cable 95 operationally coupled to the deployment hub 86 and is wound there about, such that pulling the cable 95 causes rotation of the deployment hub 86, and thereby deployment of the wheel 28 through the aperture 18 of the front panel 16. The wheel assembly 90 also includes a biased assembly 88 operationally coupled to the wheeled arm 20 and configured to bias the wheeled arm 20 in a retracted mode. The illustrated bias member 88 is a torsion spring and other bias members are contemplated including but not limited to other kinds of springs, such as but not limited to leaf springs, coil springs, compression springs, tension springs, clock springs, and the like and combinations thereof.

Figure 11:
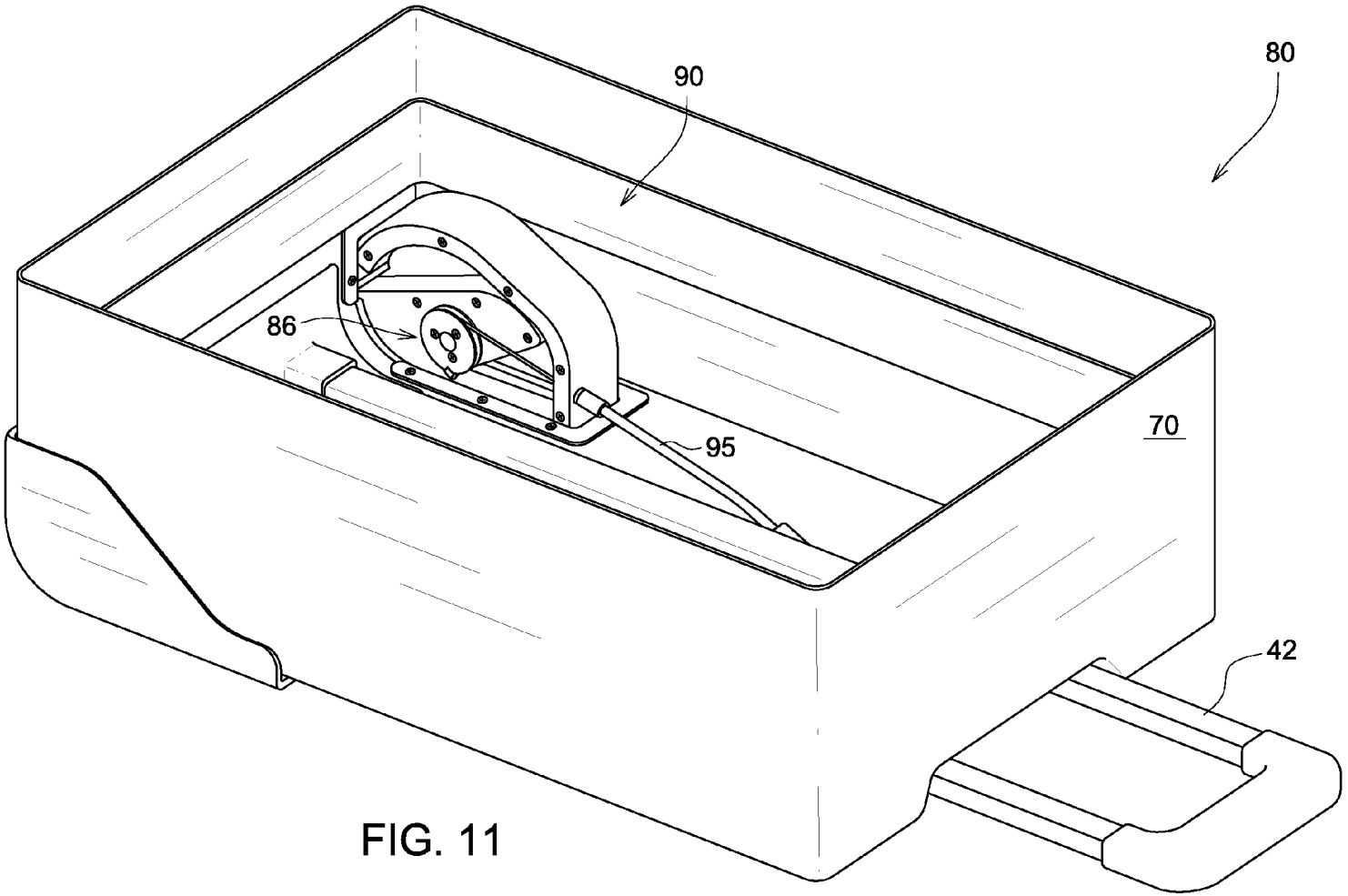
FIG. 11 is a perspective view of a wheeled container, according to one embodiment of the invention.

FIG. 11 is a perspective view of a wheeled container, according to one embodiment of the invention. There is shown a wheeled container 80 including a housing 70, a handle 42, and a wheel assembly 90.

The illustrated wheeled container 80 includes a housing 70, such as a luggage compartment of a piece luggage. The wheeled container 80 includes a handle 42 extending from a top portion 77 of the housing 70. The handle 42 is coupled to a wheel assembly 90 by a cable 95. The cable 95 is configured to extend and retract from the wheel assembly 90 when the handle 42 is extended and retracted from the housing 70. The cable 95 is functionally coupled to a deployment hub 86 of the wheel assembly 90. The deployment hub 86, when rotated by the extension and retraction of the cable 95 and the handle 42, is configured to rotate a wheeled arm of the wheel assembly and retract or deploy a wheel therefrom.

Figure 12:
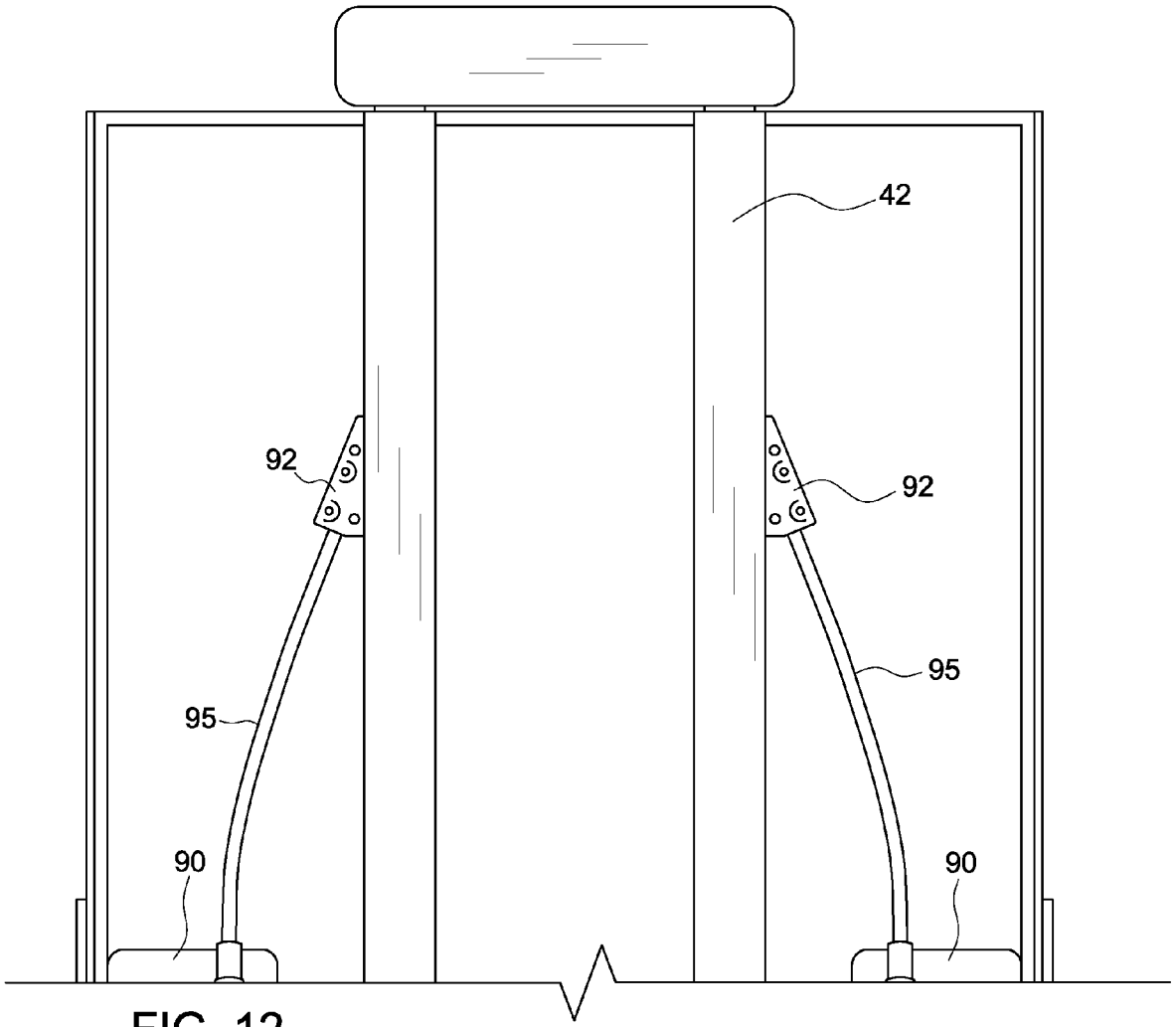
FIG. 12 is a top plan view of a cable of a wheel assembly coupled to a handle, according to one embodiment of the invention.

FIG. 12 is a top plan view of a cable of a wheel assembly coupled to a handle, according to one embodiment of the invention. There is shown a pair of wheel assemblies 90 coupled to a handle 42 of a wheeled container by a cable 95.

The illustrated handle 42 is configured to be disposed within a container and is also configured to extend from a top portion thereof. The handle 42 includes a pair of guide members 61 disposed parallel to each other and perpendicular to a gripping member 41 of the handle 42. Each guide member 61 includes a coupling device 92 configured to couple to a cable 95 of each of the wheel assemblies 90. Advantageously, a single motion of the handle by a user causes both cables to be pulled simultaneously and therefore operates each wheel assembly simultaneously with a single motion.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although specific embodiments are illustrated and described, features and structures described herein may be used in any combination, together and/or independently.

Additionally, although the figures illustrate particular configurations and/or installation, it is envisioned that one or more embodiments described herein may be installed/deployed in a variety of containers including but not limited to luggage, trunks, appliance bodies (refrigerators, washing machines, dryers, ovens, etc.), office equipment, office furniture, medical equipment, vehicles, carrying tools, tool boxes, and/or any container or container like device that may benefit from having deployable wheels.

It is also envisioned that assemblies/cartridges may be present in a container in any number and in any combinations of integral and retrofitted and may be activateable/deployable in any combination, together or independently.

It is expected that there could be numerous variations of the design of this invention. An example is that deployment of a portion of a wheel assembly may be directly caused by motion of a user, may be staged with one or more delaying structures, and/or may be indirectly caused, such as but not limited to by mechanical operation of a motion inducing device (motor, hydraulics, etc.) triggered by a toggle, button, switch, etc.

Finally, it is envisioned that the components of the device may be constructed of a variety of materials, including but not limited to metal, plastics, resins, composites, rubbers, glass, ceramics, woven fibers, wood, composites, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A retractable wheel assembly, comprising:

a) a bracing member including:

a1) a side panel; and a2) a front panel coupled to the side panel and including an aperture disposed therethrough;

b) a wheeled arm pivotally coupled to the side panel and sized and positioned such that the wheeled arm rotates through the aperture of the front panel; wherein the wheeled arm further comprises:

b1) an arm member including a first end and a second end; wherein the arm member is pivotally coupled to the side panel, between the first end and the second end;

b2) a wheel coupled to the first end of the arm member; and b3) an aperture cover coupled to the arm member and shaped and positioned such that when the wheeled arm is in a retracted mode, the aperture cover covers a majority of the aperture, but not substantially all, thereby forming a wheel gap;

c) a deployment arm coupled to the second end of the arm member;

d) a trap member operationally coupled to the deployment arm, including a trap flange sized and positioned to cover the wheel gap when in a closed mode and to substantially uncover the wheel gap in an open mode; and e) a handle operationally coupled to the trap member; and f) a variably engaging coupling device functionally disposed between the trap member and the wheeled arm, such that actuating the handle, the variably engaging coupling device engages the trap member sufficient to substantially open the wheel gap and then afterwards engages the wheeled arm, thereby causing the wheel to be rotated through the aperture while the trap member is retracted.

2. The assembly of claim 1, further comprising a second variably engaging coupling device operationally disposed between the handle and the trap member, thereby creating a two stage deployment handle.

3. The assembly of claim 1, wherein the variably engaging coupling device includes a slotted fitting having a slot length substantially equal to a length of the wheel gap.

4. The assembly of claim 1, further comprising a second wheel assembly substantially mirroring the first wheeled assembly, wherein each wheel assembly shares a single trap member having a first trap flange and a second trap flange.

5. The assembly of claim 1, further comprising a wheel rest extending orthogonally from an end of the trap flange and shaped and positioned to receive a surface of the wheel.

6. A wheeled container, comprising:

a) a housing including a1) a bottom portion having a housing aperture disposed therethrough;

a2) a top housing aperture; and a3) a bottom housing aperture;

b) a retractable wheel assembly coupled over the housing aperture; wherein the retractable wheel assembly includes:

b1) a bracing member including:

1) a side panel; and 2) a front panel coupled to the side panel and including an aperture disposed therethrough;

b2) a wheeled arm pivotally coupled to the side panel and sized and positioned such that the wheeled arm rotates through the aperture of the front panel; wherein the wheeled arm further comprises:

1) an arm member including a first end and a second end; wherein the arm member is pivotally coupled to the side panel, between the first end and the second end;

2) a wheel coupled to the first end of the arm member; and 3) an aperture cover coupled to the arm member and shaped and positioned such that when the wheeled arm is in a retracted mode, the aperture cover covers a majority of the aperture, but not substantially all, thereby forming a wheel gap;

b3) a deployment arm coupled to the second end of the arm member; and b4) a trap member operationally coupled to the deployment arm, including a trap flange sized and positioned to cover the wheel gap when in a closed mode and to substantially uncover the wheel gap in an open mode; and c) a handle extending through the top housing aperture.

7. The container of claim 6, further comprising a variably engaging coupling device functionally disposed between the trap member and the wheeled arm, such that actuating the handle, the variably engaging coupling device engages the trap member sufficient to substantially open the wheel gap and then engages the wheeled arm, thereby causing the wheel to be rotated through the aperture.

8. The container of claim 7, further comprising a second variably engaging coupling device operationally disposed between the handle and the trap member, thereby forming a two stage deployment handle.

9. The container of claim 8, wherein the variably engaging coupling device includes a slotted fitting having a slot length substantially equal to a length of the wheel gap.

10. The container of claim 9, further comprising a second wheel assembly substantially mirroring the first wheeled assembly, wherein each wheel assembly shares a single trap member having a first trap flange and a second trap flange.

11. The container of claim 10, further comprising a wheel rest extending orthogonally from an end of the trap flange and shaped and positioned to receive a surface of the wheel.

12. A kit for configuring a container with retractable wheels, comprising:

a) a wheel assembly, including:

a1) a bracing member, including:

1) a side panel; and 2) a front panel coupled to the side panel and including an aperture disposed therethrough; wherein the brace member includes coupling devices configured to couple the brace member to a container;

a2) a wheeled arm pivotally coupled to the side panel and sized and positioned such that the wheeled arm rotates through the aperture of the front panel; wherein the wheeled arm further comprises:

1) an arm member including a first end and a second end; wherein the arm member is pivotally coupled to the side panel, between the first end and the second end;

2) a wheel coupled to the first end of the arm member; and 3) an aperture cover coupled to the arm member and shaped and positioned such that when the wheeled arm is in a retracted mode, the aperture cover covers a majority of the aperture, but not substantially all, thereby forming a wheel gap;

a3) a deployment arm coupled to the second end of the arm member;

a4) a trap member operationally coupled to the deployment arm, including a trap flange sized and positioned to cover the wheel gap when in a closed mode and to substantially uncover the wheel gap in an open mode;

a5) a handle operationally coupled to the trap member; and a6) a variably engaging coupling device functionally disposed between the trap member and the wheeled arm, such that actuating the handle, the variably engaging coupling device engages the trap member sufficient to substantially open the wheel gap and then engages the wheeled arm, thereby causing the wheel to be rotated through the aperture; and b) a plurality of coupling devices configured to facilitate coupling of the wheel assembly to a container.

13. The kit of claim 12, further comprising a plurality of structural support members including coupling devices configured to couple to a container and couple to the wheel assembly.

14. The kit of claim 13, further comprising a second variably engaging coupling device operationally disposed between the handle and the trap member, thereby forming a two stage deployment handle.

15. The kit of claim 14, wherein the variably engaging coupling device includes a slotted fitting having a slot length substantially equal to a length of the wheel gap.

16. The kit of claim 12, further comprising a second wheel assembly having a structure substantially mirroring the first wheeled assembly.

17. The kit of claim 12, further comprising a wheel rest extending orthogonally from an end of the trap flange and shaped and positioned to receive a surface of the wheel.

* * * * *